US006291759B1

(12) United States Patent
Turner

(10) Patent No.: US 6,291,759 B1
(45) **Date of Patent: *Sep. 18, 2001**

(54) PICKUP FOR ELECTRIC GUITARS, AND METHOD OF TRANSDUCING THE VIBRATIONS OF GUITAR STRINGS

(75) Inventor: William T. Turner, Chino Hills, CA (US)

(73) Assignee: Fender Musical Instruments Corporation, Scottsdale, AZ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/216,447

(22) Filed: Dec. 18, 1998

Related U.S. Application Data

(63) Continuation-in-part of application No. 09/014,839, filed on Jan. 28, 1998.

(51) Int. Cl.[7] ..... G10H 3/18; H01F 21/00; H01F 27/28

(52) U.S. Cl. ..... 84/726; 336/110; 336/220; 336/221

(58) Field of Search ..... 84/726–728; 336/84 R, 336/84 M, 110, 220, 221

(56) References Cited

U.S. PATENT DOCUMENTS 3,916,751 * 11/1975 Stich ..... 84/728
4,283,982 * 8/1981 Armstrong ..... 84/728
4,442,749 * 4/1984 DiMarzio et al. ..... 84/728
4,524,667 * 6/1985 Duncan ..... 84/728
5,168,117 * 12/1992 Anderson ..... 84/726
5,834,999 * 11/1998 Kinman ..... 84/728 X

* cited by examiner

*Primary Examiner*—Stanley J. Witkowski
(74) *Attorney, Agent, or Firm*—Stradling Yocca Carlson & Rauth

(57) ABSTRACT

Guitar pickups are provided herein comprising an upper bobbin, a ferromagnetic steel plate and a lower bobbin, stacked on top of each other, oriented longitudinally and laterally substantially the same, and held together by ferromagnetic screws. An upper coil is wounded around a middle section of the upper bobbin, and a lower coil is wounded in an opposite manner around a middle section of the lower bobbin, whereby the upper and lower coils are connected in series. The upper and lower bobbins, and steel plate each include a plurality of coaxial apertures to receive corresponding permanent magnetic pole pieces that extend from the upper bobbin to the lower bobbin. The upper and lower bobbins include additional apertures to receive ferromagnetic cylinders to selectively change the tonal characteristics of the guitar. The pickups may include a pair of ferromagnetic plates attached to the longitudinal sides of the lower bobbin that extend upwards to about the middle of the upper coil. These ferromagnetic plates concentrate the electromagnetic fields around the coils. A guitar in combination with these pickups is provided herein.

23 Claims, 4 Drawing Sheets

PICKUP FOR ELECTRIC GUITARS, AND METHOD OF TRANSDUCING THE VIBRATIONS OF GUITAR STRINGS

CROSS-REFERENCE TO RELATED APPLICATION

This is a continuation-in-part of U.S. patent application Ser. No. 09/014,839, filed Jan. 28, 1998, for a Pickup for Electric Guitars.

BACKGROUND AND SUMMARY OF THE INVENTION

It is generally recognized that some of the most famous solid-body electric guitars have their own "sound", and that this "sound" differs from that generated by many other such guitars.

It is also recognized that the "sound" created by a solid-body electric guitar is determined primarily by its pickups (transducers).

Accordingly, there has long been a strong inclination for the manufacturers of famous, successful solid-body electric guitars to make little or no changes in their pickups.

However, it is also a fact that "noise" sensed by the pickups can seriously adversely affect a performance by a guitarist, or a practice session, etc. Noise, such as that resulting from electromagnetic radiation, has been recognized as being a major problem since almost the time when the electric guitar became popular.

It is therefore an object of the present invention to provide a pickup and method such that the manufacturer can duplicate the "sound" of one or more classic (or other) solid-body guitars, and at the same time achieve effective and practical reduction or elimination of noise.

The present invention in one of its aspects has symmetrically balanced coils arranged in a concentric (coaxial) configuration, with a ferromagnetic plate having certain characteristics and which is centrally common to both coils; it incorporates the humbucking pickup principle in a way that achieves maximum noise immunity.

The efficiency of the transducing of string vibrations to achieve a strong signal at the pickup is an additional important criterion of a great pickup. There is in the present pickup an improved construction and method for increasing the magnetic flux through the coils of the pickup, and near the vibrating strings, and which correspondingly increases the output voltage and signal amplitude of the pickup.

There is, in accordance with another aspect of the invention, an improved construction and method for adding or subtracting inductive components to enhance the sound and tonal characteristics of the pickup, without compromising noise immunity.

There is improved incorporation and location of pole pieces of varying lengths in the pickup to control the output, balance, and sensitivity for different diameter musical strings.

There is in the present invention improved isolation between the pickup coils to reduce phase cancellation of common frequencies, which allows the pickup to exhibit an improved harmonic content and thus richer sound and tonal quality.

In accordance with another aspect of one or more embodiments of the invention, the ferromagnetic plate serves also as a part of the bobbin for the coil, to achieve added compactness and alter the induction and the sound.

In accordance with yet another aspect of the invention, a pickup is provided herein that includes a pair of steel or ferromagnetic plates attached to the longitudinal sides of a lower bobbin. The plates preferably extend upward pass the lower coil and central ferromagnetic plate. A thin electrical insulator may separate the side plates from the central ferromagnetic plate to prevent an electrical connection between both elements. The plates concentrate the electromagnetic fields produced by the permanent magnetic pole pieces around both coils to achieve a more efficiently produced voltage at the pickup connections.

DETAILED DESCRIPTION

Figure 1:
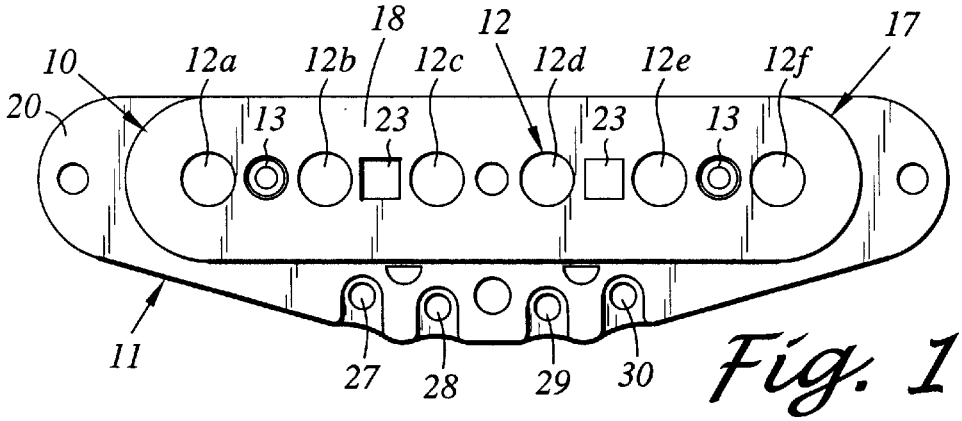
FIG. 1 is a top plan view of an electromagnetic pickup embodying the present invention.

The present invention is incorporated in an electric guitar, typically a solid-body electric guitar, such as is shown in U.S. Pat. No. 2,972,923 for a Floating Tremolo and Bridge Construction for Lute-Type Musical Instruments, inventor C. L. Fender. Said patent is hereby incorporated by reference herein.

The word "guitar", as employed in the present specification and claims, denotes any electric guitar, electric bass (electric bass guitar), etc.

The pickups shown in the drawings are for six-string guitars. However, the number of strings (and thus the pickups) may vary.

Each of the pickups shown in the drawings is symmetrical about a vertical plane that is perpendicular to the longitudinal axis of the pickup and that is midway between the ends of the pickup.

Referring to FIGS. 1–5, the core assembly of the pickup comprises an upper bobbin section, a centrally located ferromagnetic steel plate, and a lower bobbin section. Fastening screws, of ferromagnetic material, are inserted upwardly through the bobbin core at the base of the lower bobbin section. The central steel plate is provided with corresponding small apertures to receive the screws. The screws pass through apertures in the plate, the apertures in the plate being of a greater diameter than the major diameter of each screw. The plate engages the upper planar surface of the lower bobbin section.

The upper bobbin section engages the plate at the lower planar surface of the upper bobbin section. The screws are then fastened into the upper bobbin section, coupling the upper and lower bobbin sections together with the plate interposed between the upper face section of the lower bobbin and the lower face section of the upper bobbin.

Each bobbin section has a plurality of circular (cylindrical) apertures which extend and align through the central cores of the upper and lower bobbin sections to receive a plurality of corresponding rod-type permanent-magnet (magnetic) pole pieces. The plate has a plurality of corresponding circular apertures which align with the circular apertures (which receive the permanent-magnet pole pieces) in the upper and lower bobbin sections.

The circular apertures in the plate have additional small apertures adjacent to the described circular apertures, for the purpose of receiving additional ferromagnetic steel pole pieces (slugs).

The illustrated permanent-magnet (magnetic) pole pieces are of sufficient length to extend fully through the upper and lower bobbin sections.

The illustrated permanent-magnet (magnetic) pole pieces are flush at the base of the lower bobbin and extend upwardly through the upper bobbin. The illustrated magnets project a short distance above the upper bobbin surface, being positioned above the upper bobbin surface in an echelon arrangement.

To further describe the pickup shown in drawing FIGS. 1–5, it comprises an upper bobbin 10, a lower bobbin 11, six permanent-magnet pole pieces 12, screws 13, upper and lower coils (windings of wire) 14 and 15, and a ferromagnetic steel plate 17.

Upper bobbin 10 and lower bobbin 11 are formed of nonmagnetic and nonmagnetizable material, preferably a synthetic resin that is an electrical insulator. Upper bobbin 10 has upper and lower parallel plates between which the upper coil 14 is wound in a particular direction, for example clockwise as viewed from above. The lower plate is longitudinally slotted. Lower bobbin 11 has upper and lower plates also parallel to each other, the upper plate in the preferred form being longitudinally slotted and being much larger than the lower, and forming a skirt which is used for mounting purposes. The lower coil 15 is wound in lower bobbin 11 in a direction opposite to said above-indicated particular direction, for example counterclockwise as viewed from above. The coils are parallel to each other.

The upper and lower plates of upper bobbin 10 are numbered 18 and 19, respectively. The skirt plate and lower plate of lower bobbin 11 are numbered 20 and 21, respectively. The cores of the upper and lower bobbins are numbered 22*a* and 22*a*, respectively.

The six permanent-magnet pole pieces, 12*a*, 12*b*, 12*c*, 12*d*, 12*e*, 12*f*, are mounted parallel to each other in the registered apertures (holes) in upper and lower bobbins 10 and 11, as shown. The magnetic poles of the pole pieces correspond to each other. Thus, for example, all of the north poles are uppermost and all of the south poles are lowermost. For simplicity, and without limitation, this north-pole-uppermost convention is used throughout the present specification and claims.

The ferromagnetic screws 13 are mild steel screws. They not only hold the bobbins together with each other and with the ferromagnetic steel plate, but also alter the inductance of the pickup. Thus, they serve two purposes.

The indicated holes 23 (for the slugs) are between pole pieces 12*b* and 12*c*, and 12*d* and 12*e*.

There are electrical connections (FIG. 1) 27,28,29 and 30. Two of these serve the upper coil 14, and the other two serve the lower coil 15. The electrical connections at 27–30, inclusive, are such that coils 14 and 15 are series connected in opposition to each other. Because the lower winding is wound in a direction opposite the upper, the humbucking effect is achieved.

The ferromagnetic steel plate 17 is (as above stated) sandwiched between plates 19 and 20 and parallel thereto. The permanent-magnet pole pieces are perpendicular to plate 17.

Ferromagnetic cylinders are inserted in the holes 23 in order to change the inductance of the pickup. These may be changed in accordance with the desires of the musician. There may be cylinders in some holes 23 and not in others.

The permanent-magnet pole pieces 12 are preferably mounted in their respective bobbin holes by friction—the friction being sufficiently strong that the magnets 12 will not move accidentally but can be adjusted when desired so as to be nearer to or farther from the guitar strings. This is done at the factory. Each magnet 12 may also be manufactured somewhat longer or shorter. The results are controlled output, balance and sensitivity for different diameter musical strings.

Further Description of the Pickup and of the Method of Transducing the Vibrations of Guitar Strings The magnets 12 (permanent-magnet pole pieces) are caused to be highly elongate—sufficiently so that they extend (as above mentioned) through both of the coils 14,15 and through the ferromagnetic plate 17. This despite the fact that plate 17 is thick, as described below.

There is a substantially magnetically neutral zone substantially midway between the north pole of each magnet and the south pole thereof. The ferromagnetic plate 17 is oriented substantially perpendicular to magnets 12 and substantially midway between opposite ends of the magnets. Thus, the plate 17 is intentionally located in the magnetically neutral zones of magnets 12.

In addition, the plate 17 is intentionally caused to be sufficiently thick that (1) the upper portion thereof (nearest the guitar strings) contains lines of magnetic force from the north poles, while the lower portion thereof contains lines of force from the south poles, and (2) such upper portion contains few or no lines of force from the south poles, while such lower portion contains few or no lines of force from the north poles. There is accordingly a magnetic separation between the magnetic fields in the upper and lower portions of plate 17.

The ferromagnetic plate 17 is preferably made of mild steel; it is caused to be at least 0.100 inch thick. Preferably, it is at least 0.125 inch thick. Its thickness is in a range of about 0.125 inch to about 0.187 inch. Instead of one thick plate, there may be a stack of thin ferromagnetic sheets (the word plate, etc., used herein relative to the ferromagnetic plate, denotes also this stacked relationship).

Because of the above-stated factors, lines of magnetic force extend upwardly in large numbers from the north poles to the zones where the strings vibrate. The lines are not bent downwardly by ferromagnetic elements or portions located relatively near the strings. It follows that there is strong interaction between the strings and the magnetic fields, with consequent strong electrical signals.

Lines of force bend downwardly from the regions of the strings, pass through upper coil 14, and pass into the upper portion of plate 17 as above described. The lines passing through the upper coil are particularly effective in signal generation.

The plate 17 effectively separates the upper coil 14 from lower coil 15. Stated in another manner, the string vibrations are sensed very largely by upper coil 14 not lower coil 15. It follows that there is little or no cancellation of musical frequencies and harmonics by the oppositely-connected coils, so that strong musical electrical signals are achieved.

On the other hand, electromagnetic radiation and other noise-generating phenomena are sensed substantially equally by both coils and accordingly cancel each other out. The result is effective noise reduction.

It is emphasized that the illustrated pickups incorporate balanced (and matched) coils above and below the plate 17. There are substantially the same number of wire turns, wire size, etc., above an below the ferromagnetic plate.

It is emphasized that by putting the thick plate 17 in the stated magnetically neutral position, more lines of force are caused to pass through upper coil 14. This increases signal strength and efficiency of signal generation.

Lines of force are saturated substantially all the way through the upper coil 14 and the lower coil 15, but separately. Thus, the lines in the upper coil are from the north poles and those in the lower coil are from the south poles. This achieves excellent humbucking action, especially since the coils are matched, balanced, to each other.

Proceeding next to a further description of the adjusting of the inductance of the pickup, it is emphasized that the inductance is initially determined by such factors as number of turns of wire in the coils, physical coil size, coil shape, size and shape of ferromagnetic plate 17, etc. These and other factors are carefully made such that the pickup achieves substantially the desired tonal and other characteristics ("sound"). In accordance with one aspect of the present invention, elements are provided that make it possible and practical to adjust the inductance of the pickup after it has been initially manufactured.

Figure 2:
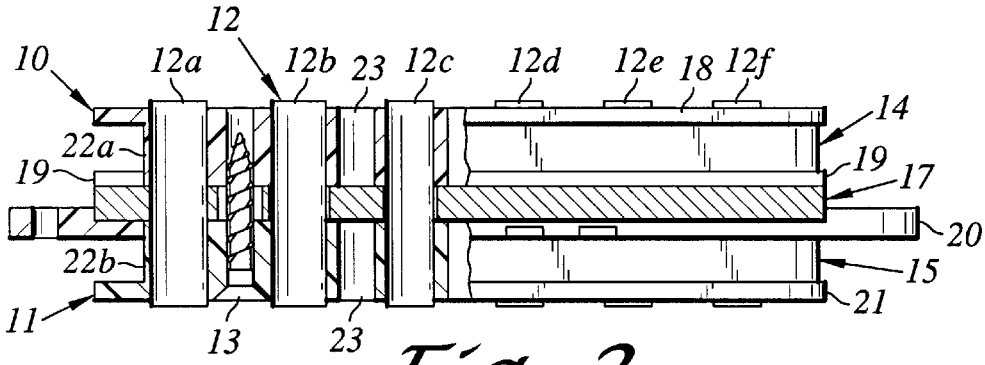
FIG. 2 is a view, the right half of which is in side elevation and the left half of which is in vertical central section, of the pickup.
Figure 4:
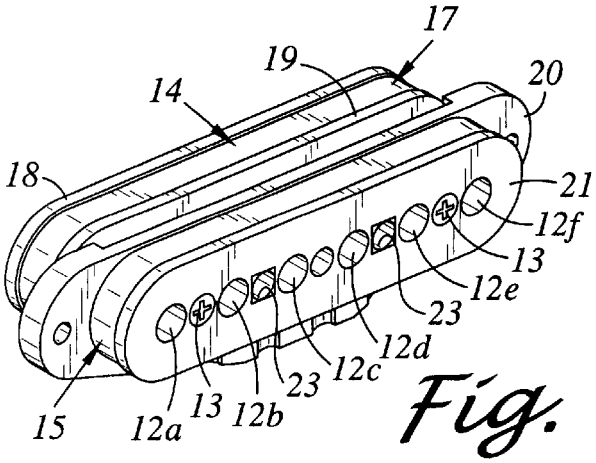
FIG. 4 is an isometric view of the pickup, and showing the side thereof opposite that shown in FIG. 1.
Figure 3:
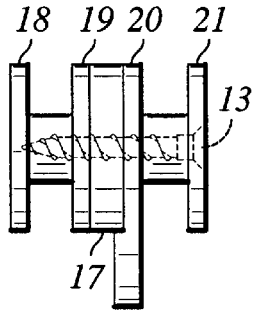
FIG. 3 is an end elevation as viewed from the right in FIG. 1, the coils being unshown.

The above-indicated holes 23 in upper and lower bobbins 10,11 are elongate, being oriented perpendicular to ferromagnetic plate 17. Preferably, holes extend from the outer bobbin surfaces down (and up) to plate 17, as shown in FIG. 2.

In the pickup shown in FIGS. 1–5, there are four holes 23, namely two in each bobbin 10,11. Two of such holes are aligned with each other, being disposed between magnets 12*b*,12*c* on opposite sides of plate 17. Correspondingly, the remaining two holes 23 are disposed between magnets 12*d*,12*e* on opposite sides of plate 17, the holes being aligned with each other.

Figure 5:
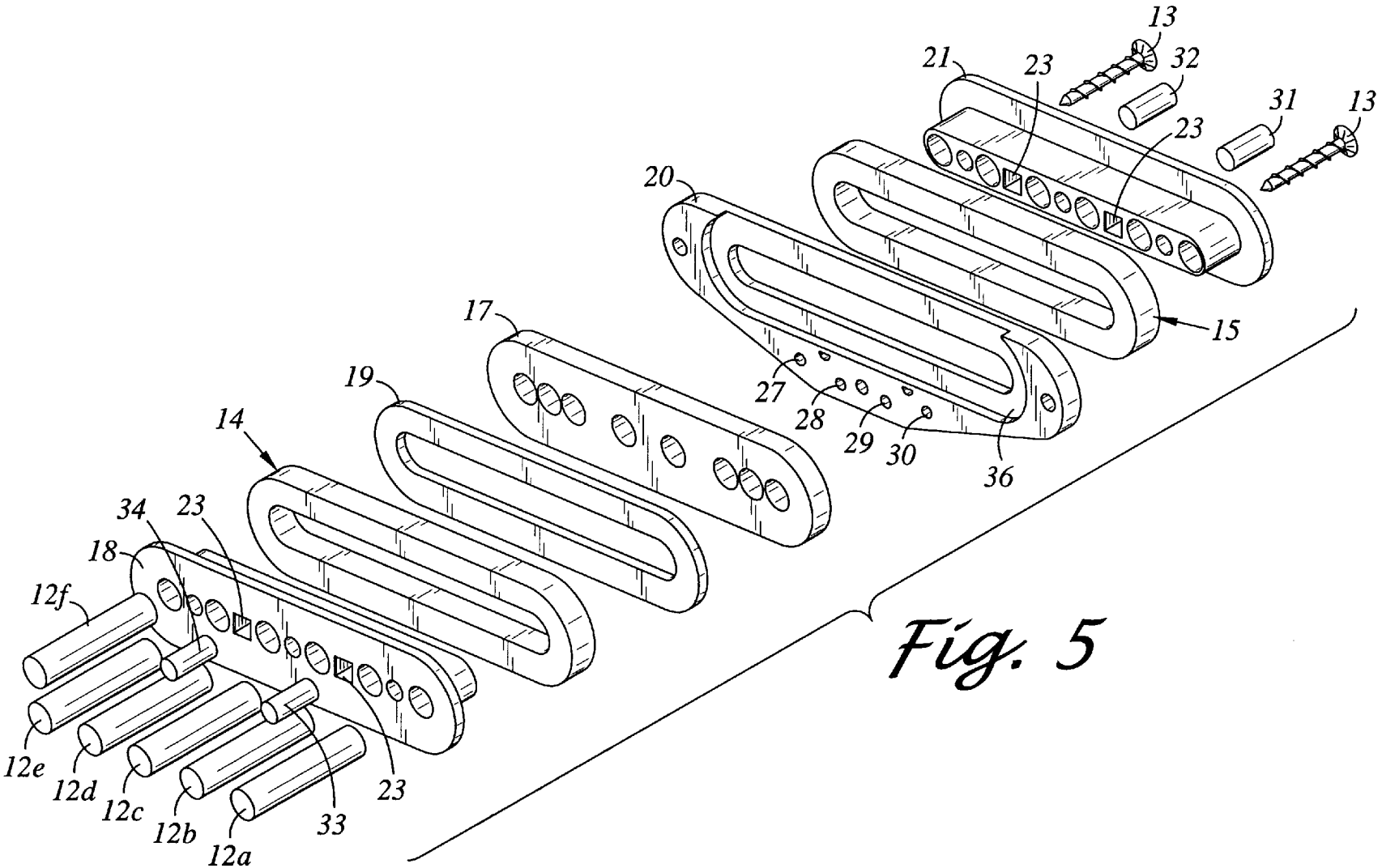
FIG. 5 is an exploded isometric view of the pickup, the left end of such view corresponding to the top of the pickup.

The above-indicated ferromagnetic cylinders, or slugs, are numbered 31–34, inclusive, being elongate mild steel cylinders. Cylinders 31–34 are illustrated in FIG. 5.

To facilitate mounting and adjustment of cylinders 31–34 in their respective holes 23, the holes are made square in cross-section; the walls of the holes frictionally hold the steel slugs.

The above-described screws 13, being ferromagnetic (mild steel), cooperate with slugs 31–34 in achieving desired adjustments of the inductance of the pickup. As shown in FIGS. 1, 2 and 5, the screws are respectively located between magnets 12*a*-12*b*, and 12*e*-12*f*. Screws 13 perform the double functions of maintaining the pickup assembled, and cooperating in varying the inductance.

To change the inductance, the cylinders (slugs) 31–34 are changed in positions, sizes (slug lengths), etc. Slugs may be mounted in some holes 23 and not others. The screws 13 may also be changed, as by employing one or both screws that are not ferromagnetic.

Figure 6:
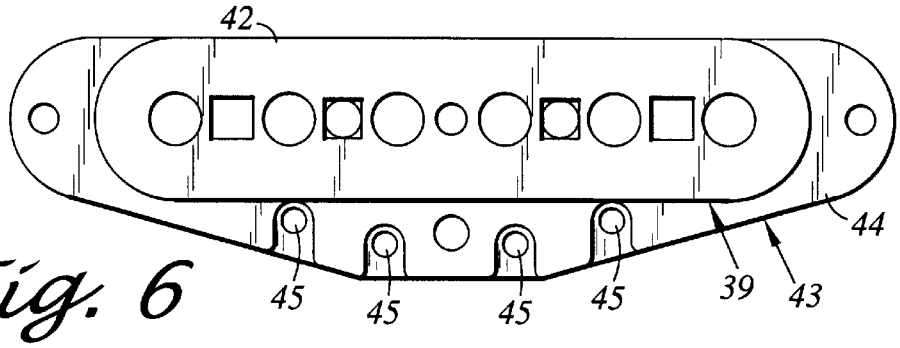
FIGS. 6 and 7 are a top plan view and a side elevation of a pickup employing the invention for a different guitar than the one for which the pickup of FIGS. 1–5 is constructed.
Figure 7:
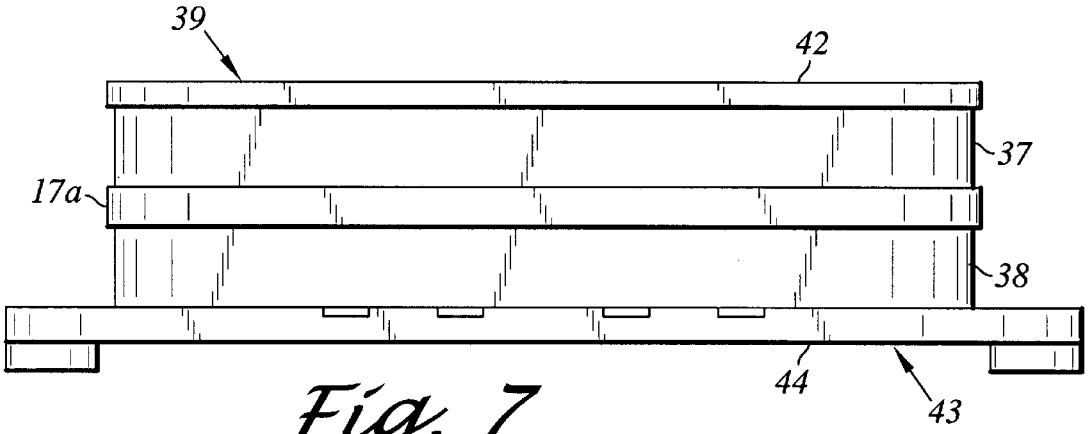

Description of the Pickup of FIGS. 6–7, Inclusive, and of an Additional Way to Achieve Desired Inductance In the pickup of FIGS. 1–5, each coil is somewhat spaced from the ferromagnetic plate 17. Thus, as best shown in FIG. 5, upper coil 14 is spaced from plate 17 by the thickness of insulating plate 19. Lower coil 15 is spaced from plate 17 by the thickness of insulating skirt plate 20 at the region thereof that contacts plate 17. Such region is quite thin, because the skirt plate is recessed at 36 (FIG. 5) to snugly receive the lower portion of plate 17. The stated spacing of the coils 14,15 from plate 17 is a factor in determining the inductance of the pickup, and the sound that the pickup puts out.

Referring next to FIGS. 6 and 7, a second pickup is shown. Except as specifically stated below, this second pickup is constructed identically to the pickup of FIGS. 1–5.

The upper and lower matched (except for direction of winding) humbucking coils 37 and 38 are each thick, in comparison to the coils of the pickup of FIGS. 1–5. Furthermore, the number of turns of wire, and other factors, are made different (in comparison to the pickup of FIGS. 1–5), all for the purpose of achieving the desired sound for a different guitar model than the model incorporating the pickup of FIGS. 1–5.

The ferromagnetic plate 17*a* sandwiched between the coils is not spaced therefrom, but instead engages one and normally both (as shown). Thus, the coils 37,38 are very close to the plate 17*a*, in contact therewith, but there is no electrical connection between plate and coils because a suitable coating (or coatings) is provided in order to achieve electrical insulation. Also, a thin paper, etc., may be used between the plate and each coil.

With the described construction, the upper bobbin 39 is only a half bobbin, having only an upper side 42 from which extends downwardly the insulating bobbin core portion that is within coil 37. Except for dimensions, the construction corresponds to that illustrated at the left in FIG. 5 relative to the upper bobbin plate 18 and connected core 22*a*.

Correspondingly, in the pickup illustrated in FIGS. 6 and 7, the lower bobbin 43 has no plate or flange adjacent ferromagnetic plate 17*a*. Instead, it has a lower bobbin plate/skirt plate 44 that is large in size and has thereon the electrical connection elements 45 that are used to make the opposing connection between the reverse-wound humbucking coils 37,38.

Bobbin plate/skirt plate 44 is connected to an insulating core corresponding (except for dimensions) to that, numbered 22*b*, shown at the right in FIG. 5. The ferromagnetic screws hold the cores against opposite sides of plate 17*a*.

Figure 8:
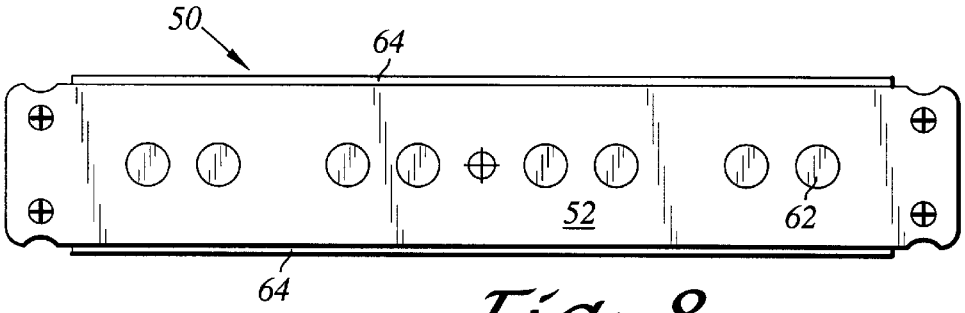
FIGS. 8–11 illustrate, by example, top, front, side and blow-up views of a pickup in accordance with another aspect of the invention.
Figure 9:
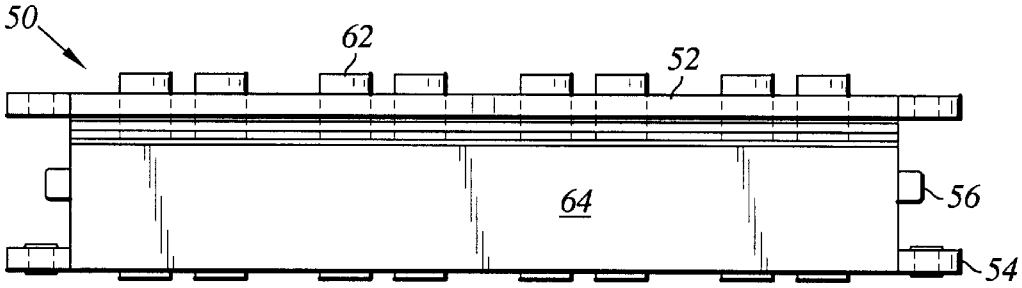
Figure 11:
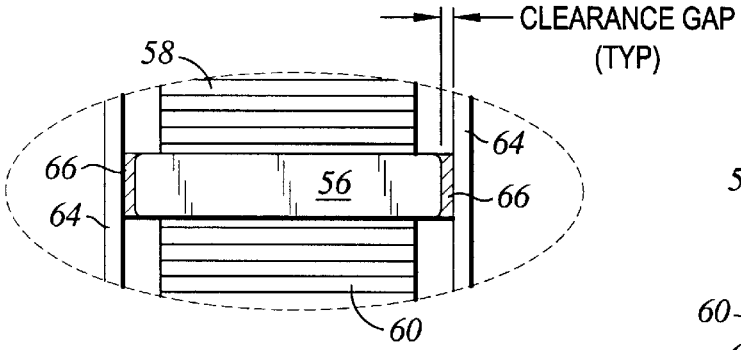
Figure 10:
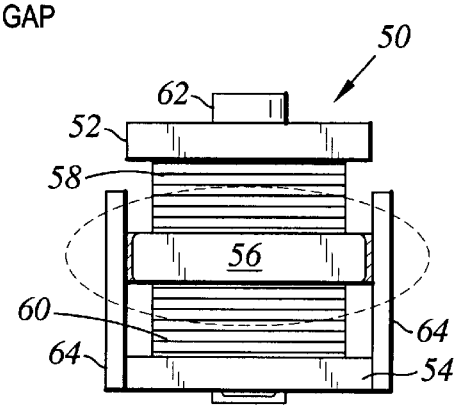

Description of the Pickup of FIGS. 8–11 and of an Additional Way to Achieve Desired Inductance FIGS. 8–11 illustrate, by example, an additional embodiment of a guitar pickup 50 in accordance with yet another aspect of the invention. Specifically, FIG. 8 depicts a top, plan view of the pickup 50, FIG. 9 is a front elevation view of the pickup, FIG. 10 depicts a side elevation view of the pickup, and FIG. 11 illustrates a blow-up view of a central section of the pickup shown in FIG. 10. The pickup 50 may be similarly constructed as per either pickups of FIGS. 1–7, but includes an additional feature described below. Accordingly, the pickup 50 includes an upper bobbin 52, a lower bobbin 54, a ferromagnetic steel plate 56, an upper coil 58, a lower coil 60, and a plurality of permanent-magnet pole pieces 62, which are similarly configured as either of the embodiments shown in FIGS. 1–7.

The pickup 50 further includes a pair of thin plates 64 preferably having respective lower portions attached to at least the front and rear side of lower bobbin 54. The plates 64 extend upward from the lower bobbin 54 above the lower coil 60 and ferromagnetic steel plate 56. As better shown in FIG. 11, the plates 64 do not make an electrical connection with the ferromagnetic steel plate 56. In the preferred embodiment, a thin electrical insulation material 66 is positioned between the plates 64 and the ferromagnetic steel plate 56 to prevent an electrical connection between both elements. The purpose for electrically insulating the side plates 64 from the ferromagnetic steel plate 56 is to prevent coupling of the poles of the permanent magnet pole pieces 62 to the side plates 64. The plates 64 can also be configured to be spaced apart from the ferromagnetic steel plate 56 without the use of the insulator 66. Also, in the preferred embodiment, the thin plates 64 are formed of steel material, but it shall be understood that other ferromagnetic materials can be used for these plates.

The purpose of the steel plates 64 is to concentrate the electromagnetic fields generated by the permanent-magnet pole pieces 62 around the coils 58 and 60 of the pickup 50. The concentrated electromagnetic fields around the coils 58 and 60 increase the coupling between the electromagnetic sensing of the string vibration and the voltage produced at the pickup electrical connection. This results in a more efficient generation of voltage at the coil ends or electrical connections of the pickup 50.

Figure 12:
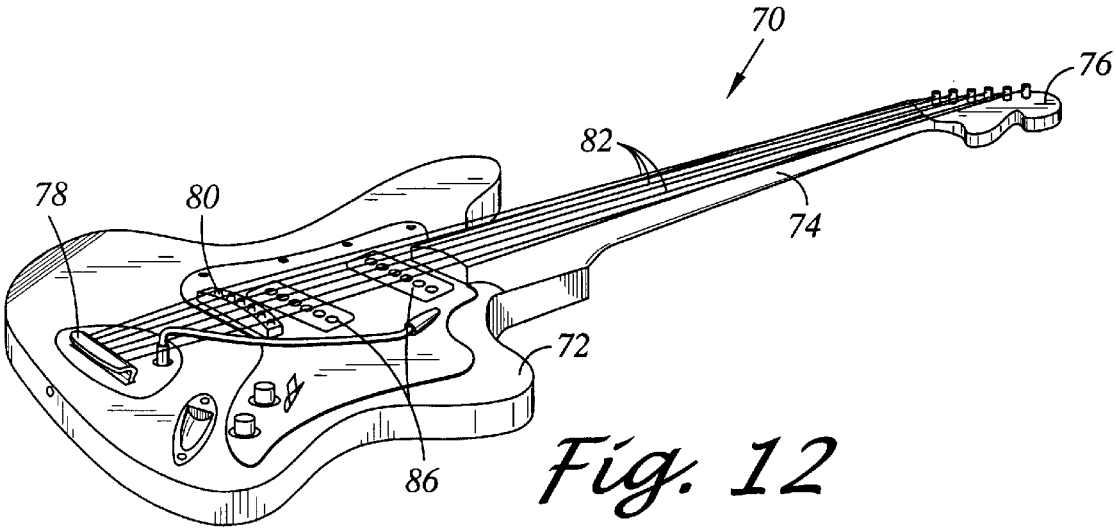
FIG. 12 illustrates, by example, a perspective view of a guitar in accordance with yet another aspect of the invention.

FIG. 12 illustrates, by example, a perspective view of a solid-body electric guitar 70 in accordance with another aspect of the invention. As typical of most guitars, the guitar 70 comprises a body 72, a neck 74, a head 76, a string-holding plate 78, bridge 80 and strings 82. The strings 82 are attached at one end to plate 78 and at the other end to tuning pegs situated on the head 76 of the guitar 70. The steel strings 82 are supported by the bridge 80 and the interface between the neck 74 and the head 76 in a tension fit, as customary of most guitars. The guitar 70 includes at least one pickup 86, and preferably two, of the type described herein and illustrated in FIGS. 1–11. The pickups 86 are preferably mounted on the body of the guitar, preferably situated within an pair of registered apertures (not shown) formed within the body between the bridge 80 and the neck 74. The permanent-magnetic pole pieces of the pickups 86 are preferably situated below and substantially aligned with the strings 82 of the guitar 70, so that the pickups can sense the vibration of the strings during play.

Although a solid-body electric guitar 70 is used to illustrate this aspect of the invention, it shall be understood that the pickups described herein can be used on any type of guitar, including acoustic guitars, as long as the guitars have electromagnetic interacting strings, such as steel strings. The pickups 86 need not be situated into registered apertures formed through the body of the guitar 70, but can be positioned anywhere on the guitar so that they electromagnetically interact with the strings. Other configurations of guitar exist in addition to the one disclosed in FIG. 12, that one skilled in the art can configure so that the pickups can sense the vibrations of the strings during play.

Summary of the Method

In accordance with the method of the invention, an electric guitar is provided having a plurality of substantially parallel and adjacent tensioned strings formed (typically) of steel. An elongate permanent-magnet pole piece is mounted near each string but spaced therefrom to permit string vibration. Such magnets extend generally parallel to each other, in generally a single plane, in a direction away from the strings. The polarity of each magnet is the same as all the others, all north (for example) poles being nearest the strings and all south poles being remote therefrom.

Substantially matched and balanced coils are provided, having generally the same number of turns of fine wire. Each coil is mounted around the magnets, so that one coil is relatively "near" the strings and the other coil is relatively "far" from them. The coils are substantially concentric. They are wound in opposite directions relative to each other, and are connected to each other in series-circuit relationship and in opposition to each other, so as to be humbucking.

A thick ferromagnetic plate is mounted between the stated "near" and "far" coils. The plate has the characteristics stated above relative to plate 17.

Lines of magnetic force from the north poles emanate from the north poles of the magnets, extend upward to the near strings for interaction therewith, and pass downward through the "near" coil to and through the region of the plate nearest the strings. From there they extend back up to the north pole, many passing near the strings.

The lines of force from the north poles are not caused to pass through ferromagnetic portions or elements located relatively near the elevation of the magnet end portions that are nearest the strings. Thus, the lines of force do not bend relatively sharply downwardly but instead pass near the strings.

Lines of force emanate from the south poles, then extend toward the strings through the "far" coil. The lines enter the ferromagnetic plate, in the portion thereof that is relatively far from the strings. They pass back down to the south poles.

When the strings are caused to vibrate, there is strong transducing interaction with the lines of force from the north poles. This, and the interaction with the "near" coil, generates strong musical signals; these are conducted to electrical amplifier means. There is little or no interaction with the "far" coil.

The "near" coil and the "far" coil, and the magnets and their lines of force, interact substantially equally with extraneous electromagnetic signals and other noise. This creates corresponding noise signals that substantially cancel each other.

While the invention has been described in connection with various embodiments, it will be understood that the invention is capable of further modifications. This application is intended to cover any variations, uses or adaptation of the invention following, in general, the principles of the invention, and including such departures from the present disclosure as come within known and customary practice within the art to which the invention pertains.

What is claimed is:

1. A pickup for electric guitars, comprising:

(a) an upper bobbin, (b) a lower bobbin beneath said upper bobbin, (c) an upper wire coil in said upper bobbin, (d) a lower wire coil in said lower bobbin, said coils being substantially matched to each other and oppositely wound, (e) a plurality of elongate permanent-magnet pole pieces extending through said bobbins and coils, said pole pieces all having their north poles uppermost, and (f) a single, uniformly flat, non-magnetized, ferromagnetic plate, said plate being disposed between said bobbins and disposed entirely within a plane parallel to said coils the plate including longitudinal ends situated approximately below said upper wire coil, said pole pieces being substantially perpendicular to said plate, and said plate being generally midway between the ends of said pole pieces.

2. The invention as claimed in claim 1, wherein said ferromagnetic plate is at least 0.100 inch thick.

3. The invention as claimed in claim 1, in which said plate has a thickness in the range of about 0.125 inch to about 0.187 inch.

4. The invention as claimed in claim 1, in which said single, uniformly flat, non-magnetized plate does not connect to any ferromagnetic portion that extends upwardly to the elevation of the upper end portions of said pole pieces.

5. The invention as claimed in claim 1, in which said single, uniformly flat, non-magnetized plate does not connect to any ferromagnetic portion that extends downwardly to the elevation of the lower end portions of said pole pieces.

6. The invention as claimed in claim 1, in which said single, uniformly flat, non-magnetized plate does not connect to any ferromagnetic portion that extends upwardly to the elevation of the upper end portions of said pole pieces, and in which said single, uniformly flat, non-magnetized plate does not connect to any ferromagnetic portion that extends downwardly to the elevation of the lower end portions of said pole pieces.

7. The invention as claimed in claim 1, in which at least said upper bobbin has holes therein generally between at least some of said pole pieces, and in which ferromagnetic slugs are mounted in at least some of said holes.

8. The invention as claimed in claim 1, in which screws are provided to hold said bobbins, pole pieces and plate together, said screws being ferromagnetic.

9. The invention as claimed in claim 1, in which each of said bobbins has an outer plate but does not have an inner plate, and in which said coils have inner portions that are closely adjacent opposed surfaces of said ferromagnetic plate.

10. The invention as claimed in claim 1, further including a pair of steel plates attached to both longitudinal sides of one of the bobbins and extending towards the opposing bobbin past the ferromagnetic plate and not in physical or electrical contact therewith.

11. A pickup for an electric guitar, which comprises:

(a) at least several highly elongate permanent-magnet pole pieces mounted in spaced parallel relationship to each other and generally coextensive with each other, all of said pole pieces having their north ends uppermost, (b) a first coil of wire wound in one direction, (c) a second coil of wire wound in the direction opposite to said one direction, said coils being generally matched to each other, said first coil being mounted around upper portions of said pole pieces, said second coil being mounted around lower portions of said pole pieces, said first and second coils being electrically connected to each other in opposed relationship so as to create a humbucking effect, said first and second coils being substantially parallel to each other and being spaced a substantial distance from each other, and (d) a single, uniformly flat, non-magnetized ferromagnetic plate disposed entirely within a plane defining a magnetically neutral location between said first and second coils and substantially parallel thereto, the plate including longitudinal ends situated approximately below said first coil, said pole pieces being substantially perpendicular to said plate, said pole pieces extending through said plate, said plate being substantially halfway between the ends of said pole pieces.

12. The invention as claimed in claim 11, wherein said ferromagnetic plate is at least 0.100 inch thick.

13. The invention as claimed in claim 11, in which said plate has a thickness in the range of about 0.125 inch to about 0.187 inch.

14. The invention as claimed in claim 11, in which said uniformly flat, non-magnetized plate does not connect to any ferromagnetic portion that extends upwardly to the elevation of the upper end portions of said pole pieces.

15. The invention as claimed in claim 11, in which said uniformly flat, non-magnetized plate does not connect to any ferromagnetic portion that extends downwardly to the elevation of the lower end portions of said pole pieces.

16. The invention as claimed in claim 11, in which said uniformly flat, non-magnetized plate does not connect to any ferromagnetic portion that extends upwardly to the elevation of the upper end portions of said pole pieces, and in which said uniformly flat, non-magnetized plate does not connect to any ferromagnetic portion that extends downwardly to the elevation of the lower end portions of said pole pieces.

17. The invention as claimed in claim 11, in which at least said upper bobbin has holes therein generally between at least some of said pole pieces, and in which ferromagnetic slugs are mounted in at least some of said holes.

18. The invention as claimed in claim 11, in which screws are provided to hold said bobbins, pole pieces and plate together, said screws being ferromagnetic.

19. The invention as claimed in claim 11, in which each of said bobbins has an outer plate but does not have an inner plate, and in which said coils have inner portions that are closely adjacent opposed surfaces of said plate.

20. The invention as claimed in claim 11, further including a pair of steel plates attached to both longitudinal sides of one of the bobbins and extending towards the opposing bobbin past the ferromagnetic plate and not in physical or electrical contact therewith.

21. A pickup for an electric guitar, which comprises:

(a) at least several highly elongate permanent-magnet pole pieces mounted in spaced parallel relationship to each other and generally coextensive with each other, all of said pole pieces having their north ends uppermost, (b) a first coil of wire wound in one direction, (c) a second coil of wire wound in the direction opposite to said one direction, said coils being generally matched to each other, said first coil being mounted around upper portions of said pole pieces, said second coil being mounted around lower portions of said pole pieces, said first and second coils being electrically connected to each other in opposed relationship so as to create a humbucking effect, said first and second coils being substantially parallel to each other, and (d) a single, uniformly flat, non-magnetized, ferromagnetic plate mounted in a substantially magnetically neutral location between said first and second coils and substantially parallel thereto and including longitudinal ends situated approximately below said first coil, said pole pieces being substantially perpendicular to said plate, said pole pieces extending through said plate, said plate being substantially halfway between the ends of said pole pieces, (e) first and second nonmagnetic and nonmagnetizable bobbins mounted one above the other and respectively receiving said coils, at least one of said bobbins having a hole therein between two adjacent ones of said pole pieces, and (f) a ferromagnetic slug mounted in said hole.

22. A method of transducing into electrical signal the vibrations of guitar strings, and of substantially eliminating noise from electromagnetic and other noise sources, said method comprising:

(a) providing a highly elongate permanent-magnet pole piece for each string of the guitar and extending downwardly from a point that is relatively close to the string but is at least sufficiently far therefrom to permit the string to vibrate, the north pole of each pole piece being uppermost, (b) providing upper and lower oppositely wound and generally matched electrical coils around the upper and lower portions of said pole pieces, (c) providing a uniformly flat, non-magnetized, ferromagnetic plate between said coils and substantially parallel to said coils and substantially midway between the ends of said pole pieces, in a substantially magnetically neutral location said ferromagnetic plate having longitudinal ends situated approximately below said upper coil, and (d) causing said plate to be sufficiently thick that the lines of magnetic force of said pole pieces are in two separate paths, the lines from the north poles of said magnets going through the side of said plate nearest the guitar strings, and the lines from the south poles going through the side of said plate farthest from the guitar strings.

23. A combination comprising:

a guitar; and a pickup mounted on said guitar comprising:

(a) at least several highly elongated permanent-magnet pole pieces for electromagnetically sensing vibrations of the strings, the pole pieces being mounted in spaced parallel relationship to each other and generally coextensive with each other, all of said pole pieces having their north ends uppermost, (b) a first coil of wire wound in one direction, (c) a second coil of wire wound in the direction opposite to said one direction, said first coil being mounted around upper portions of said pole pieces, said second coil being mounted around lower portions of said pole pieces, said first and second coils being electrically connected to each other in opposed relationship so as to create a humbucking effect, said first and second coils being substantially parallel to each other, and (d) a uniformly flat, non-magnetized, ferromagnetic plate mounted in a substantially magnetically neutral location between said first and second coils and substantially parallel thereto and including longitudinal ends situated approximately below said first coil, said pole pieces being substantially perpendicular to said plate, said pole pieces extending through said plate, (e) first and second nonmagnetic and nonmagnetized bobbins mounted one above the other and respectively receiving said coils, at least one of said bobbins having a hole therein between two adjacent ones of said pole pieces, and (f) a ferromagnetic slug mounted in said hole.

* * * * *